US006463685B1

(12) United States Patent
Tynes

(10) Patent No.: US 6,463,685 B1
(45) Date of Patent: Oct. 15, 2002

(54) STEAM IRON WITH VARIABLE STEAM CONTROL

(75) Inventor: Ronald G. Tynes, Glen Allen, VA (US)

(73) Assignee: Hamilton Beach/Proctor-Silex, Inc., Glen Allen, VA (US)

( * ) Notice: Subject to any disclaimer, the term of this patent is extended or adjusted under 35 U.S.C. 154(b) by 226 days.

(21) Appl. No.: 09/634,063

(22) Filed: Aug. 8, 2000

(51) Int. Cl.[7] ..... D06F 75/18
(52) U.S. Cl. ..... 38/77.8
(58) Field of Search ..... 38/77.8, 77.5, 38/77.83; 251/117, 149.2, 208, 211, 251, 262, 311

(56) References Cited

U.S. PATENT DOCUMENTS 4,296,560 A * 10/1981 Schwob ..... 38/77.83
4,910,895 A * 3/1990 Rethmeier et al. ..... 38/77.5
5,531,037 A * 7/1996 Pons et al. ..... 38/77.8
5,829,175 A * 11/1998 Marchetti et al. ..... 38/77.8

* cited by examiner

*Primary Examiner*—Ismael Izaguirre
(74) *Attorney, Agent, or Firm*—Roger S. Dybvig

(57) ABSTRACT

A steam iron including a soleplate, a steam chamber having an upper surface portion with a water inlet opening, a water reservoir having a bottom surface portion with a water outlet opening and a valve assembly for directing controlled amounts of water from the reservoir into the steam chamber. The valve assembly including a valve port member having a body formed of a matrix of material with a bore and hollow bypass conduit. The upwardly-facing surface of the valving portion including an opening for the hollow bypass conduit. The hollow bypass conduit having a lower end open along an inside wall portion of the valving portion of the bore, a valve element extending into the bore, rotatable about an axis for controlling the flow of water through the valving portion. The valving portion including first and second barriers such that rotation of the valving element allows the user to allow or prevent water from flowing to the steam chamber.

20 Claims, 5 Drawing Sheets

FIG-6
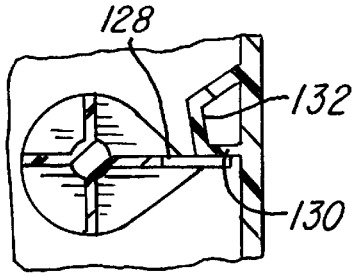
FIG-10
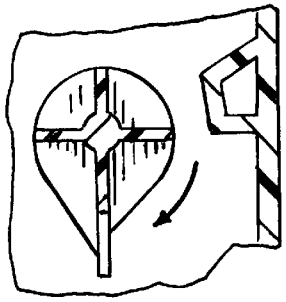
FIG-7
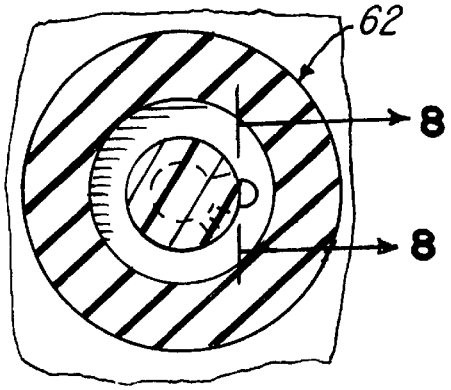
FIG-11
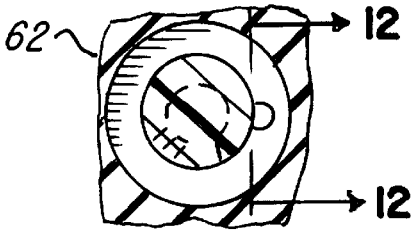
FIG-8
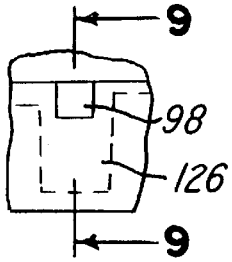
FIG-12
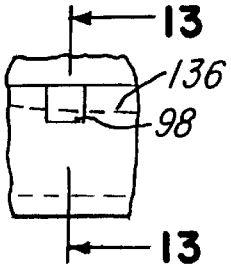
FIG-5
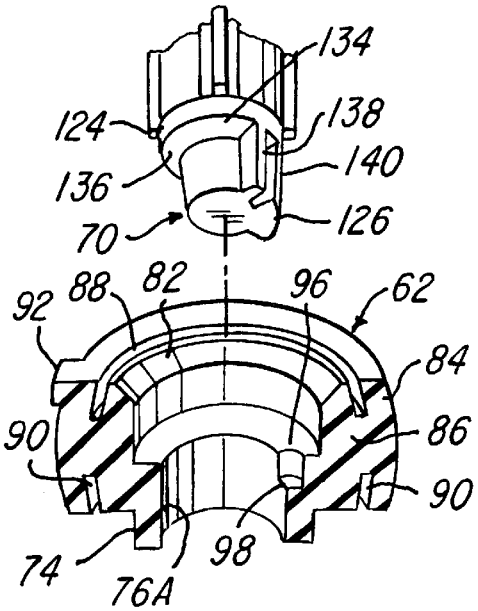
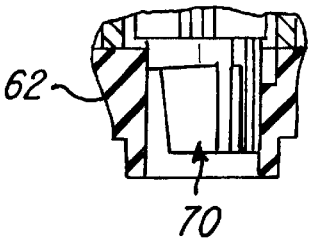
FIG-9
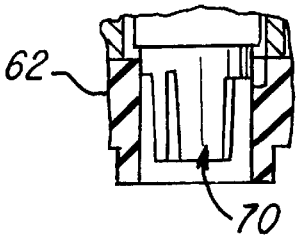
FIG-13

STEAM IRON WITH VARIABLE STEAM CONTROL

FIELD OF THE INVENTION

This invention relates to a steam iron with a variable steam control assembly primarily intended for domestic use, although the invention is not necessarily so limited.

BACKGROUND OF THE INVENTION

Steam irons often are provided with mechanisms for changing the rates at which steam exits from steam outlet ports in the sole plates. There are occasions during which steam irons are used when no steam is desired and other occasions during which a specific rate of steam production is desired. The rate varies with the fabric being ironed and with the preferences of the person using a steam iron.

Steam is usually produced in steam irons by dispensing small quantities of water from a water reservoir through a restricted orifice into a steam chamber formed by the top surface of the sole plate and a cover plate which covers and is sealed to a portion of the sole plate. In a domestic iron, typical steam production rates are on the order of 1 to 15 grams of steam per minute. Since small quantities of water are used to produce steam within the typical range of flow rates, small differences in the size of the orifice can make substantial differences in the steam flow rates. A substantial number of cooperating parts is typically required to achieve reliable adjustments to the steam production rates in prior iron constructions. The cost of the steam production control mechanism adds significantly to the overall cost of a steam iron.

SUMMARY OF THE INVENTION

A primary object of the present invention is to provide a steam iron having a variable steam control which is inexpensive yet rugged and reliable. A steam iron in accordance with this invention comprises a sole plate, a steam chamber having an upper surface portion with a water inlet opening, a water reservoir having a bottom surface portion with a water outlet opening, and a valve assembly for directing controlled quantities of water from the reservoir into the steam chamber. The valve assembly includes a valve port member at the bottom of the water reservoir. The valve port member, which preferably comprises matrix of flexible, resilient material, such as silicon rubber, has a bore through which water from the reservoir is dispensed into the steam chamber. In addition, the valve port member has a hollow bypass conduit including an upper open end that opens to one side of the bore and a lower open end that opens along an inside wall of the bore.

The valve assembly further includes a valve element extending into the bore, and rotatable about the axis of the bore, that prevents water from flowing through the bore except for water that passes through the bypass conduit into the bore. The valve element includes a first barrier that can, by rotation of the valve element, confront and cover the open lower end of the bypass conduit to prevent water from exiting from the bypass conduit into the bore. To provide varying amounts of water passing through the bore, the valve element can be rotated to position a second, variable barrier in confronting relation to the lower end of the bypass conduit. The second barrier partly uncovers the open lower end of the bypass conduit to permit a controlled dispensing of water from the water reservoir into the steam chamber. The second barrier terminates in a third barrier which, when confronting the bypass conduit, substantially reduces the amount of water exiting from the water reservoir. A cavity is formed between the first and the third barrier which opens the bypass conduit to the extent that the steam chamber can be flooded for purging the valve assembly.

Other objects, advantages and features of this invention will become apparent from the following description and the drawings.

BRIEF DESCRIPTION OF THE DRAWINGS

FIG. 5 is an exploded, fragmentary isometric view of the steam control shaft and the valve port, showing the valve port member in cross section.

FIG. 6 is a cross-sectional view taken along line 6—6 of FIG. 2, showing the steam control shaft rotated to one end position thereof.

FIG. 7 is a fragmentary elevational view, with parts in cross section, taken along line 7—7 of FIG. 2, showing the position of a valve element at the bottom of the steam control relative to the valve port member at the end position illustrated in FIG. 6.

FIG. 8 is a fragmentary elevational taken along line 8—8 of FIG. 7 of the inside wall of a bore in the valve port member and showing, by phantom lines, the position of a valve element barrier relative to the valve port member at the end position illustrated in FIG. 6.

FIG. 9 is a fragmentary cross-sectional view, taken on line 9—9 of FIG. 8, which also shows the position of the valve element barrier relative to the valve port member at the end position of the parts illustrated in FIG. 6.

FIG. 10 is a cross-sectional view similar to FIG. 6 but showing the steam control shaft rotated to an intermediate position to permit a relatively small quantity of water to drain from the water reservoir through a bypass conduit into the steam chamber.

FIG. 11 is a fragmentary elevational view, with parts in cross section, similar to FIG. 7, showing the position of the valve element at the bottom of the steam control relative to the valve port member at the intermediate position of the parts illustrated in FIG. 10.

FIG. 12 is a fragmentary elevational taken along line 12—12 of FIG. 11 of the inside wall of the bore in the valve port member and showing, by phantom lines, the position of a valve element barrier relative to the valve port member at the intermediate position illustrated in FIG. 10.

FIG. 13 is a fragmentary cross-sectional view, taken on line 13—13 of FIG. 12, which also shows the position of the valve element barrier relative to the valve port member at the intermediate position of the parts illustrated in FIG. 10.

DETAILED DESCRIPTION

Figure 1:
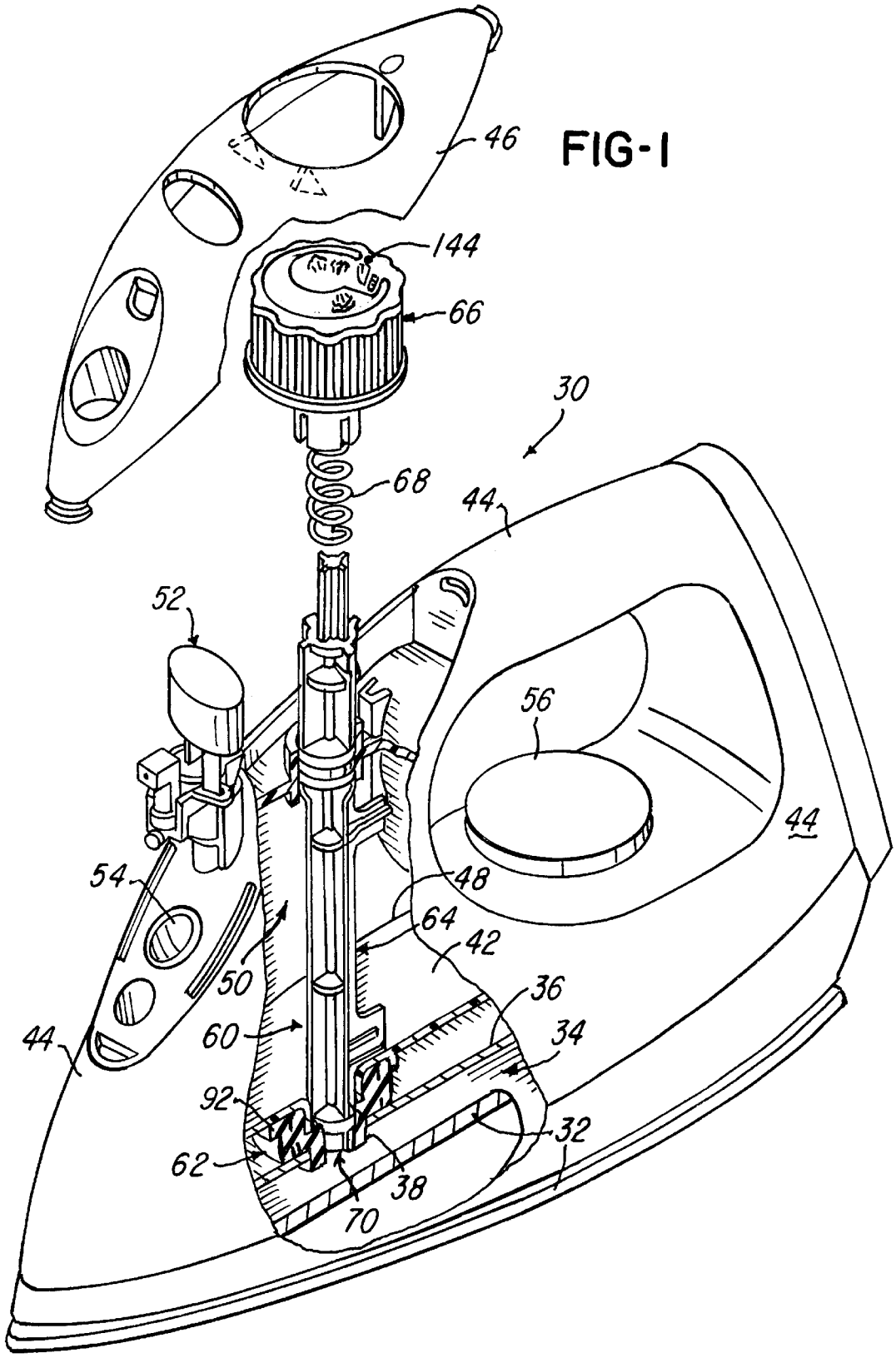
FIG. 1 is a partly exploded, fragmentary, isometric view of a steam iron in accordance with this invention, with parts broken away to better illustrate other parts.
Figure 2:
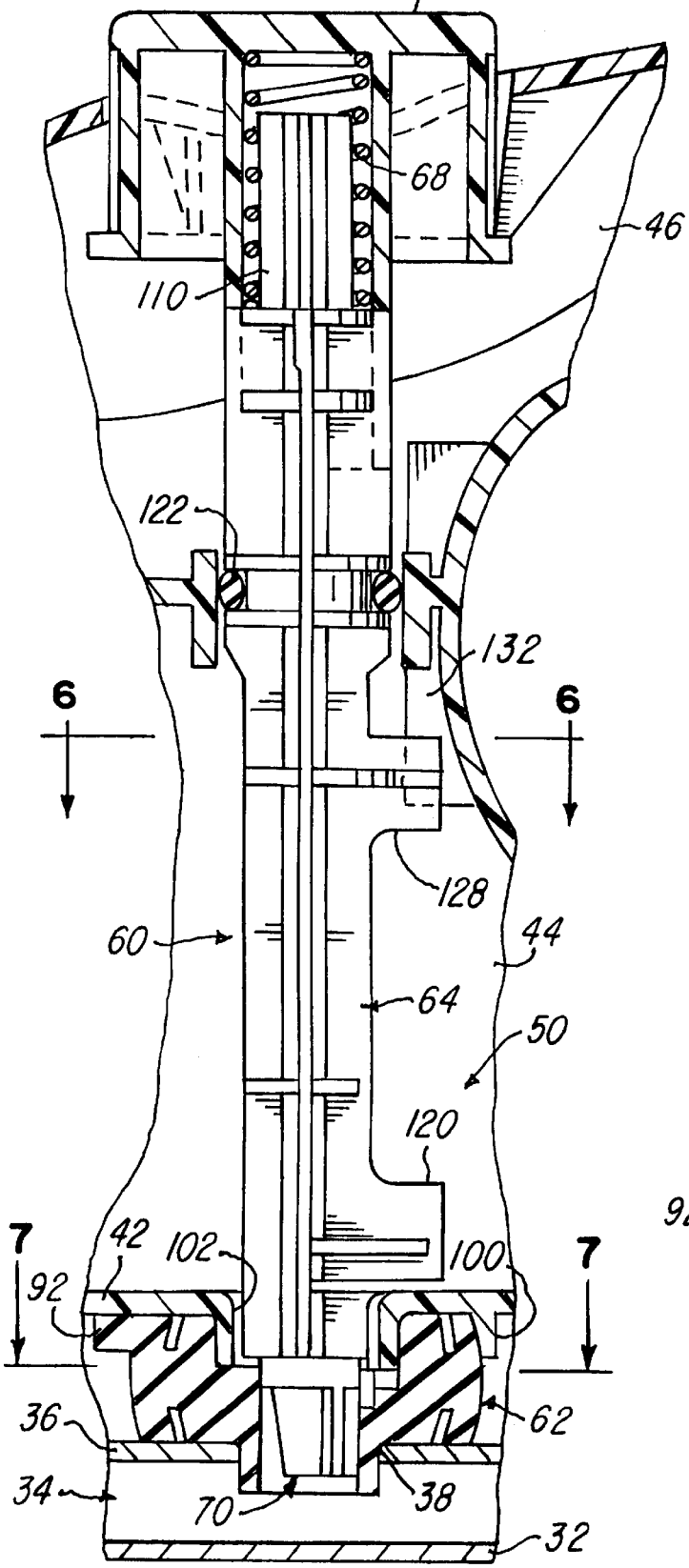
FIG. 2 is a fragmentary, longitudinal cross-sectional view of parts of the steam iron of FIG. 1 and particularly the steam control assembly of this invention.

Referring to FIGS. 1 and 2, this invention is directed to a steam iron, generally designated 30, having a sole plate 32, a steam chamber 34 formed by the top surface of the sole plate 32 and a top wall 36 sealed to the sole plate 32. The steam chamber top wall 36 has a water inlet opening 38. The iron 30 additionally includes a housing 40 formed by a base cover 42, a handle 44 and a top cover 46 that can be snapped onto the handle 44. Here it may be noted that, as used in this description and the claims that follow, relative terms such "upwardly" and "downwardly", "vertical" and "horizontal" are with reference to a steam iron oriented such that its sole plate lies flat against a horizontal surface.

In the embodiment illustrated in the drawings, the base cover 42 and the handle 44 have mutually joined surfaces, such as at 48 in FIG. 1, sealed to one another to form a cold water reservoir 50. As is well understood in the art, the sole plate 32 has a heater (not shown). Water from the water reservoir 50 drips onto the top of the heated sole plate 32 to form steam in the steam chamber 34. The steam travels through labyrinths to steam exit openings (not shown) in the sole plate 32. Here it should be noted that the details of construction of the cold water reservoir are mostly unimportant for the purposes of this invention. Many other constructions are possible. As one example, this invention could be used with a cold water reservoir (not shown) that is separate from and mounted between the base cover 42 and the handle 44.

In FIG. 1, the iron 30 is shown also to include a water spray pump assembly 52, a water inlet spout 54 that leads to the water reservoir 50, and a thermostat adjusting knob 56, the details of which may be conventional and are unimportant for purposes of this invention.

Figure 3:
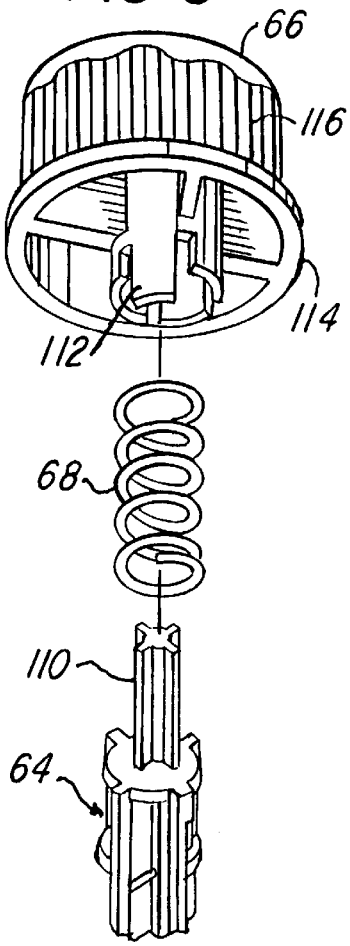
FIG. 3 is an exploded, fragmentary, isometric view of the assembly of a steam control knob, a steam control shaft and a coil spring associated therewith.
Figure 4:
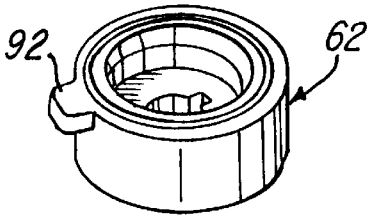
FIG. 4 is an isometric view of a valve port member of the iron of FIG. 1.
Figure 14:
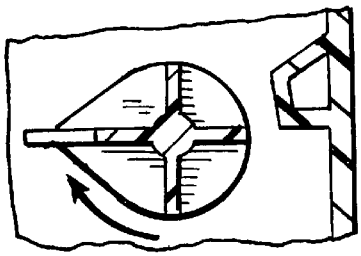
FIG. 14 is a cross-sectional view similar to FIGS. 6 and 10 but showing the steam control shaft rotated to a second intermediate position to permit a larger quantity of water to drain from the water reservoir through the bypass conduit into the steam chamber.

In accordance with this invention, a novel, inexpensive and reliable steam control valve assembly 60 shown assembled in FIG. 2 is provided for directing differing quantities of water from the water reservoir 50 to the steam chamber 34. Referring to FIGS. 1, 2 and 3, the valve assembly 60 includes a valve port member 62, a steam control shaft 64, a steam control knob 66, and a compression spring 68. A valve element 70 is located at the bottom of the control shaft 64 and integral therewith. The control shaft 64 is preferably molded from a heat resistant plastic material, such as polyester, of which many are commercially available.

With reference to FIGS. 2, 4, 22 and 23, the valve port member 62 is made in one-piece from a matrix of flexible and resilient material, such as silicon rubber, and comprises a cylindrical body 72 having a central, downwardly extending, cylindrical projection 74 that extends through the steam chamber opening 38 into the steam chamber 34. The body 72 has a through bore 76 with a larger diameter counterbore 78 that creates an upwardly facing shoulder 80 inside the valve body 72 which shoulder 80 surrounds the lower, smaller diameter end, designated 76A, of the through bore 76. The top of the valve body 72 is countersunk to form a beveled inside margin 82. A narrow, ring-shaped band 84 encircles the valve body 72 and is connected to the valve body 72 by an annular web 86. An upper annular groove 88 and a lower annular groove 90 separate the upper and lower margins, respectively, of the valve body 72 from the band 84. A locating boss 92 projects forwardly from the upper part of the band 84 to enable the valve port member 62 to be oriented for reasons which will become apparent.

The lower, uniform and smaller diameter portion 76A of the through bore 76 functions as a cylindrical valving portion which is centered on its longitudinal axis which is coincident with the axis of the steam chamber inlet opening 38. The edge formed by the upper end of the valving portion 76A and the shoulder 80 has a notch 94 effective to provide a hollow bypass conduit having an upper end 96 (FIG. 23) open to the shoulder 80 and a lower end 98 open along the inside wall of the valving portion 76A. The employment of the notch 94 to provide the bypass conduit is preferred, but other constructions could be used, such as a conduit extending from the shoulder 80 to the inside wall of the valving portion 76A spaced outwardly from the edge joining the shoulder 80 to the valving portion 76A.

The valve port member 62 is held centered with respect to the steam chamber inlet opening 38 by a circular flange 100 that extends downwardly from the bottom of the base cover 42. The forward portion of the flange has a gap which receives the locating boss 92 to so orient the valve port member 62 that the conduit notch 94 is aligned along the centerline of the iron.

During manufacture of the steam iron 30, the valve port member 62 is compressed between the water reservoir 50 and the steam chamber 34. The relatively narrow band 84 is squeezed to form a watertight seal surrounding the valve port body 72. A funnel shaped opening 102 is formed in the base cover 42 in alignment with the steam chamber inlet 38. The margins of the opening 102 enter into the counterbore 78. As can be seen in FIG. 2, the entire valve port member 62 is securely clamped in a fixed position and forms a good, watertight seal between the water reservoir 50 and the steam chamber 34.

With reference to FIGS. 2 and 3, the upper end of the steam control shaft 64 has four equally-spaced ribs 110 projecting outwardly from a central core around which the spring 68 is coiled. The knob 68 has a hollow stem 112 with sections interfitting with the ribs 110 such that the ribs 110 can only fit in one orientation on the control shaft 64 and so that rotation of the knob 68 in either direction will cause rotation of the control shaft 64. The hollow stem 112 also houses the spring 68, which biases the knob 68 upwardly so that an outer flange 114 at the bottom of the knob's outer skirt 116 is held against stops 118 provided on the bottom of the top cover 46. The spring 68 also biases the control shaft 64 downwardly so that a lower stop member 120 on the control shaft 64 engages the top surface of the base cover 42 to ensure a proper vertical alignment between the valve element 70 and the valve port member 62.

An o-ring 122 is mounted. in a groove in the control shaft 64 to provide a seal between the top wall of the water reservoir 50 and the control shaft 64. The frictional engagement of the o-ring 122 with the water reservoir top wall, the lower stop 42 with the base cover 42 and the valve element 70 with the valve port member 62 ensures that the control shaft will remain in any manually selected position and provides a tactile feel to resist rotation of the control knob 68.

With reference to FIGS. 5 through 9, the valve element 70 comprises a disk-like body 124 and a first barrier 126 extending downwardly from the body 124 that is adapted by its size and shape to be positioned by rotation of the control shaft 64 in confronting relation to the lower bypass opening 98. When so positioned, the first barrier 126 closes the bypass lower end 98 to prevent liquid from exiting from the water reservoir 50 to the lower end of the through bore 76. In this position of the control shaft 64, an upper stop plate 128 carried by the control shaft 64 engages a first stop surface 130 of a stop member 132 molded integrally with the handle 44.

The section of the disk-like body extending circumferentially, in a counterclockwise direction, as viewed in FIG. 5, forms a second barrier 134, which only partly closes the open lower end 98 of the bypass notch 94. The bottom surface of the second barrier 134 is formed to provide a circumferentially-extending peripheral ramp 136 which slopes upwardly in the counterclockwise direction, again as shown in FIG. 5, so that increasing amounts of water can be permitted to be dispensed from the water reservoir 50 into the steam chamber 34 as the control knob 68 is rotated in a clockwise direction, as viewed in FIG. 10, for example. FIGS. 10 through 13 diagrammatically reveal the opening of the lower end 98 of the notch 94 after the control shaft 64 has been rotated through 90 degrees from the first stop position. FIGS. 14 through 17 reveal the greater opening of the lower end 98 after 180 degrees of rotation of the control shaft 64 from the first stop position. With further rotation of the control shaft 64, even greater amounts of water will be dispensed up to a maximum at the end of the peripheral ramp 136, at which a third barrier 138, which may be vertically coextensive with the first barrier 126, substantially limits the flow of water through the lower window 98.

Figure 18:
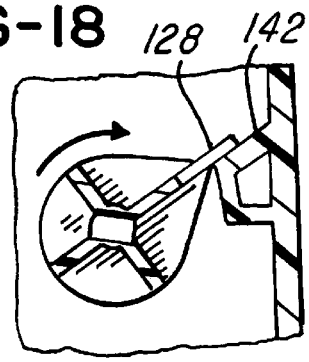
FIG. 18 is a cross-sectional view similar to FIGS. 6, 10 and 14, but showing the steam control shaft rotated to a second end position thereof.
Figure 15:
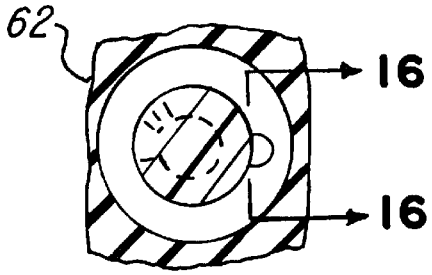
FIG. 15 is a fragmentary elevational view, with parts in cross section, similar to FIGS. 7 and 11, showing the position of the valve element at the bottom of the steam control relative to the valve port member at the second intermediate position of the parts illustrated in FIG. 14.
Figure 19:
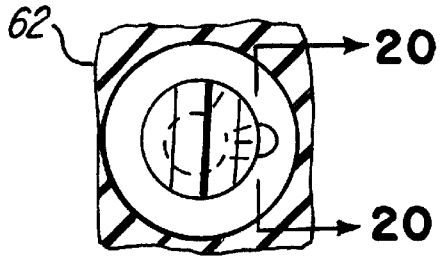
FIG. 19 is a fragmentary elevational view, with parts in cross section, similar to FIGS. 7, 11 and 15, showing the position of the valve element at the bottom of the steam control relative to the valve port member at the second end position of the parts illustrated in FIG. 18.
Figure 16:
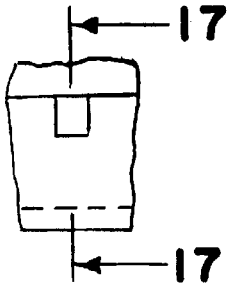
FIG. 16 is a fragmentary elevational taken along line 16—16 of FIG. 15 of the inside wall of the bore in the valve port member and showing, by phantom lines, the position of the valve element barrier relative to the valve port member at the second intermediate position illustrated in FIG. 14.
Figure 20:
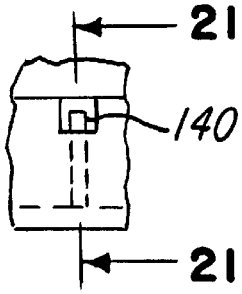
FIG. 20 is a fragmentary elevational taken along line 20—20 of FIG. 19 of the inside wall of the bore in the valve port member and showing, by phantom lines, the position of the valve element barrier relative to the valve port member at the second end position illustrated in FIG. 18.
Figure 17:
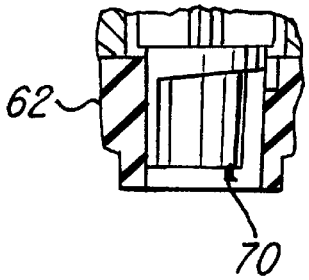
FIG. 17 is a fragmentary cross-sectional view, taken on line 17—17 of FIG. 16, which also shows the position of the valve element barrier relative to the valve port member at the second intermediate position of the parts illustrated in FIG. 14.
Figure 21:
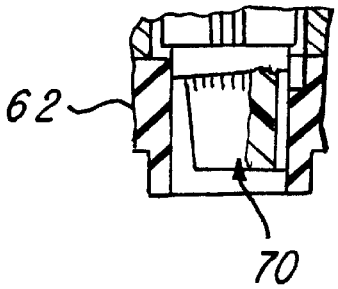
FIG. 21 is a fragmentary cross-sectional view, taken on line 21—21 of FIG. 20, which also shows the position of the valve element barrier relative to the valve port member at the second end position of the parts illustrated in FIG. 14.
Figure 22:
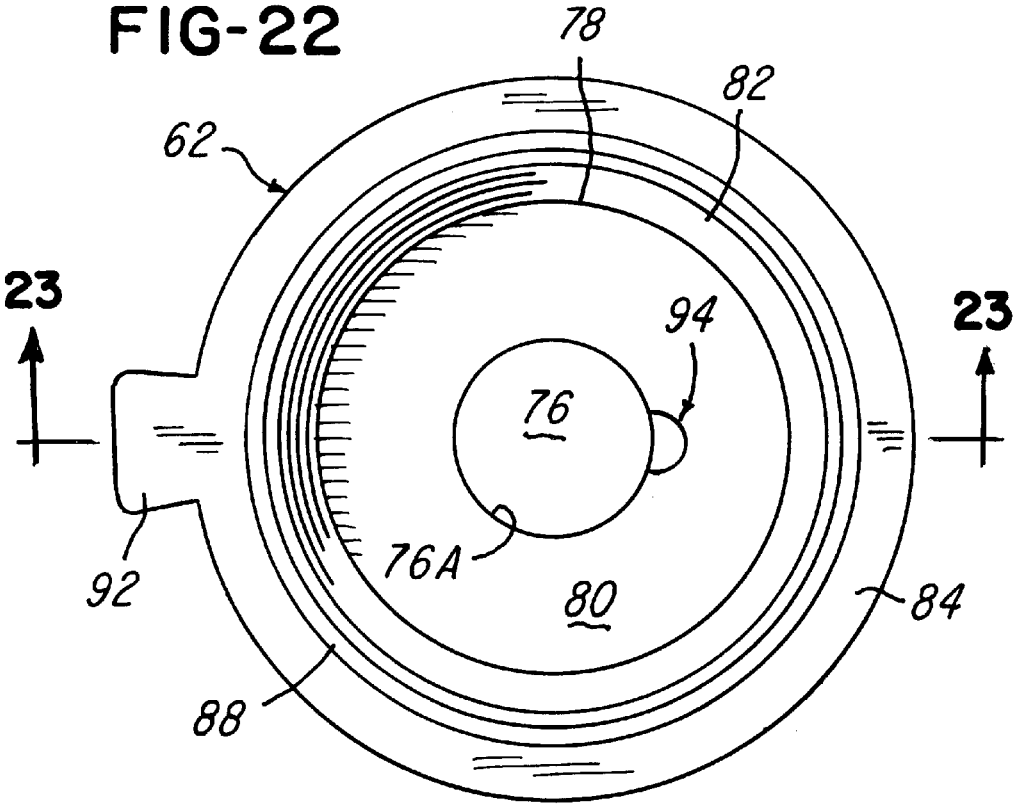
FIG. 22 is a greatly enlarged top plan view of the valve port member.
Figure 23:
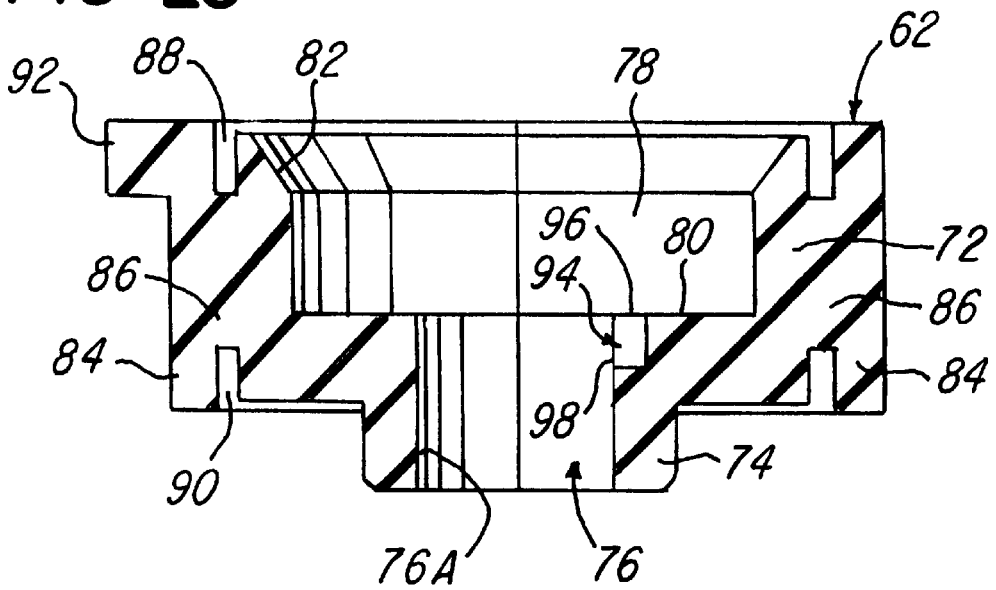
FIG. 23 is a cross-sectional view of the valve port member taken on line 23—23 of FIG. 22.

With reference to FIGS. 18 through 21, the control shaft 64 may be rotated through an additional several degrees past the maximum water delivery position to position a cavity 140 between the first barrier 126 and the third barrier 138 into confronting relationship with the lower notch end 98. At this point, the upper stop plate 128 engages a second stop surface 142 on the stop member 132, as illustrated in FIG. 18. This provides maximal exposure of the open lower end 98 of the notch 94, and is used to flood the steam chamber 34 for cleaning out the lower end of the valve assembly, the steam chamber 34, and the steam vent holes (not shown) in the sole plate 32.

The top surface of the control knob 68 is provided with artwork 144, which is preferable molded into the knob 68, to indicate to the user the results that will be achieved at various rotary positions of the control knob 68.

Although criteria may differ, the valve assembly of this invention can be constructed to produce steam from a lower limit of zero grams per minute to a maximum of about 13 grams per minute. A water flow rate of 20 grams per minute can be used to flood the steam chamber, with the control shaft 64 at the second stop position illustrated in FIGS. 18 through 21.

Although the presently preferred embodiment of this invention has been described, it will be understood that within the purview of the invention various changes may be made within the scope of the following claims.

I claim:

1. A steam iron comprising a sole plate, a steam chamber having an upper surface portion with a water inlet opening, a water reservoir having a bottom surface portion with a water outlet opening, and a valve assembly for directing controlled quantities of water from said reservoir into said steam chamber, said valve assembly comprising:

a valve port member at the bottom of said water reservoir, said valve port member having a body formed from a matrix of material with a bore through which water from said reservoir can be dispensed into said steam chamber, said bore having a cylindrical valving portion of uniform diameter and centered on a longitudinal axis, an upwardly-facing surface surrounding the upper end of said cylindrical valving portion, and a hollow bypass conduit having an upper end open to said upwardly-facing surface and, accordingly, to the inside of said water reservoir, and said hollow bypass conduit having a lower end open along an inside wall portion of said valving portion of said bore; and a valve element extending into said bore, rotatable about said axis, that prevents water from flowing through said valving portion except for water that passes through said bypass conduit into said valving portion, said valve element comprising a first barrier that can, by rotation of said valve element, be aligned with said lower end of said bypass conduit and completely cover the open lower end of said bypass conduit to prevent water from exiting from said bypass conduit into said bore portion, and said valve element having a second barrier that, when aligned with said bore, partly uncovers the open lower end of said bypass conduit to permit a controlled volume of water to exit through said bypass conduit into said bore whereupon a controlled volume of water is dispensed from said water reservoir into said steam chamber.

2. The steam iron of claim 1 wherein said second barrier has a circumferentially extending lower surface that slopes along its circumferential length so that said valve element may be rotated to align different portions of said second barrier with said open lower end of said bypass conduit to vary the volume of water dispensed from said water reservoir into said steam chamber and thereby the amount of steam produced in said steam chamber.

3. The steam iron of claim 2 wherein said valve element is located at the bottom of a control shaft, and said steam iron further comprises a manually rotatable knob having portions interfitting said control shaft so that rotation of said knob causes rotation of said control shaft and thereby said valve element to control the amount of steam produced by the steam iron.

4. The steam iron of claim 3 comprising an upper housing.

5. The steam iron of claim 4 wherein a compression spring is confined between said knob and said control shaft to bias said knob upwardly and said control shaft downwardly, wherein said control shaft has an abutment which engages a lower stop to limit downward movement of said control shaft and thereby properly set the height of said second barrier relative to said open lower end of said bypass conduit.

6. The steam iron of claim 5 wherein said water reservoir has an upper wall and a lower wall, and wherein said lower stop comprises the lower wall of said water reservoir.

7. The steam iron of claim 6 wherein said upper wall of said water reservoir has an opening extending therethrough centered on said axis, and wherein an o-ring sealing member is mounted on said control shaft and engaged within said opening.

8. The steam iron of claim 5 wherein said knob has a stop member engaged with upper stops in said upper housing to limit upward movement of said knob.

9. The steam iron of claim 5 wherein said stop member of said knob comprises an outwardly projecting circumferential flange.

10. The steam iron of claim 9 wherein upper housing comprises a handle and a top cover, said upper stop members being integral with said top cover.

11. The steam iron of claim 5 wherein said outer housing has an index mark adjacent said knob and said knob has markings indicating various operating positions of said valve element which are aligned with said index mark different rotary positions of said knob.

12. The steam iron of claim 11 wherein rotary movements of said knob are limited by cooperating stop surfaces on said knob and within said upper housing.

13. The steam iron of claim 1 wherein said steam chamber is formed by a portion of said sole plate and a steam chamber cover sealed to said sole plate.

14. The steam iron of claim 13 wherein valve port member is confined between said lower wall of said water reservoir and said steam chamber cover.

15. The steam iron of claim 1 wherein said valve port member is made from a flexible and resilient material, such as silicon rubber, and comprises a cylindrical central body, said bore extending along said axis centrally through said body, said upwardly facing surface comprising a planar surface countersunk within said body.

16. The steam iron of claim 15 wherein said valve port member further comprises a tubular projection extending from said central body into said steam chamber, a portion of said bore extending through said tubular projection and opening inside said steam chamber.

17. The steam iron of claim 16 wherein said valve port member further comprises a narrow outer band encircling said central body and integral with said body, the upper and lower ends of said band being separated from said body by respective upper and lower grooves to enable said body and said band to be compressed between said water reservoir and said steam chamber to provide a seal against leakage of water around said body.

18. The steam iron of claim 17 wherein said band has a vertical height greater than said central body.

19. The steam iron of claim 1 wherein said bypass conduit comprises a single notch recessed from both said upwardly facing surface and the upper end of said valving portion.

20. A steam iron comprising a sole plate, a steam chamber having an upper surface portion with a water inlet opening, a water reservoir having a bottom surface portion with a water outlet opening, and a valve assembly for directing differing quantities of water from said reservoir into said steam chamber, said valve assembly comprising:

a valve port member at the bottom of said water reservoir, said valve port member having a body formed from a matrix of material with a bore through which water from said reservoir can be dispensed into said steam chamber, and a hollow bypass conduit having an upper end open to said upwardly-facing surface and, accordingly, to the inside of said water reservoir, and said hollow bypass conduit having a lower end open along an inside wall portion of said valving portion of said bore; and a valve element extending into said bore, rotatable about said axis, that prevents water from flowing through said bore except for water that passes through said bypass conduit into said bore, said valve element comprising a first barrier that can, by rotation of said valve element, confront said lower end of said bypass conduit and completely cover the open lower end of said bypass conduit to prevent water from exiting from said bypass conduit into said bore, said valve element having a second barrier that, when confronting the open lower end of said bypass conduit, partly uncovers the open lower end of said bypass conduit to permit a controlled volume of water to exit through said bypass conduit into said bore whereupon a controlled volume of water is dispensed from said water reservoir into said steam chamber, said second barrier having a circumferentially extending lower surface that slopes along its circumferential length so that said valve element may be rotated to align different portions of said second barrier with said open lower end of said bypass conduit to vary the volume of water dispensed from said water reservoir into said steam chamber and thereby the amount of steam produced in said steam chamber, a cavity which, when confronting said open lower end of said bypass conduit, permits sufficient water to bypass said valve element to flood the steam chamber, and a third barrier separating said cavity from said second barrier.

* * * * *